US006099251A

United States Patent [19]

LaFleur

[11] Patent Number: 6,099,251

[45] Date of Patent: Aug. 8, 2000

[54] COOLABLE AIRFOIL FOR A GAS TURBINE ENGINE

[75] Inventor: Ronald Samuel LaFleur, Potsdam, N.Y.

[73] Assignee: United Technologies Corporation, Hartford, Conn.

[21] Appl. No.: 09/110,532

[22] Filed: Jul. 6, 1998

[51] Int. Cl.[7] ..... F01D 5/18; F01D 9/04

[52] U.S. Cl. ..... 416/97 R; 416/97 A; 415/115

[58] Field of Search ..... 415/115; 416/96 R, 416/96 A, 97 R, 97 A

[56] References Cited

U.S. PATENT DOCUMENTS

| | | | |
|---|---|---|---|
| 3,301,526 | 1/1967 | Chamberlain | 415/115 |
| 3,542,486 | 11/1970 | Kercher et al. | 416/97 R |
| 3,799,696 | 3/1974 | Redman . | |
| 4,314,442 | 2/1982 | Rice . | |
| 4,347,037 | 8/1982 | Corrigan | 416/97 A |
| 4,505,639 | 3/1985 | Groess et al. | 416/97 R |
| 4,545,197 | 10/1985 | Rice . | |
| 4,565,490 | 1/1986 | Rice . | |
| 4,653,983 | 3/1987 | Vehr . | |
| 4,664,597 | 5/1987 | Auxier et al. . | |
| 4,669,957 | 6/1987 | Phillips . | |
| 4,672,727 | 6/1987 | Field . | |
| 4,676,719 | 6/1987 | Auxier et al. . | |
| 4,726,735 | 2/1988 | Field et al. . | |
| 4,738,588 | 4/1988 | Field . | |
| 4,753,575 | 6/1988 | Levengood et al. . | |
| 4,762,464 | 8/1988 | Vertz et al. . | |
| 4,835,958 | 6/1989 | Rice . | |
| 4,859,147 | 8/1989 | Hall et al. . | |
| 4,940,388 | 7/1990 | Lilleker et al. . | |
| 4,992,025 | 2/1991 | Stroud et al. . | |
| 5,100,293 | 3/1992 | Anzai et al. | 416/96 A |
| 5,193,975 | 3/1993 | Bird et al. . | |
| 5,342,172 | 8/1994 | Coudray et al. . | |
| 5,356,265 | 10/1994 | Kercher . | |
| 5,374,162 | 12/1994 | Green . | |
| 5,387,085 | 2/1995 | Thomas, Jr. et al. . | |
| 5,392,515 | 2/1995 | Auxier et al. . | |
| 5,403,159 | 4/1995 | Green et al. . | |
| 5,405,242 | 4/1995 | Auxier et al. . | |
| 5,419,039 | 5/1995 | Auxier et al. . | |
| 5,419,681 | 5/1995 | Lee . | |
| 5,458,461 | 10/1995 | Lee et al. . | |
| 5,486,093 | 1/1996 | Auxier et al. . | |
| 5,496,151 | 3/1996 | Coudray et al. . | |
| 5,498,133 | 3/1996 | Lee . | |
| 5,690,473 | 11/1997 | Kercher | 416/97 A |

FOREIGN PATENT DOCUMENTS

| | | | |
|---|---|---|---|
| 2127105 | 4/1984 | United Kingdom | 416/97 R |

*Primary Examiner*—Christopher Verdier
*Attorney, Agent, or Firm*—Richard D. Getz

[57] ABSTRACT

A hollow airfoil is provided having a leading edge, a trailing edge, and a wall including a suction side portion and a pressure side portion. The wall, which includes an interior surface and an exterior surface, surrounds a first cavity and a second cavity, separated from one another by a rib extending between the suction side and pressure side wall portions. The first cavity is contiguous with the leading edge. The airfoil further includes a coolant flow splitter attached to the wall interior surface within the first cavity, and at least one metering orifice disposed in the rib. The metering orifice(s) are substantially aligned with the coolant flow splitter, such that cooling air passing through the metering orifice(s) encounters the flow splitter. The flow splitter splits the cooling air flow and directs it along the wall interior surface.

6 Claims, 2 Drawing Sheets

COOLABLE AIRFOIL FOR A GAS TURBINE ENGINE

The Government has rights in this invention, pursuant to Contract No. F33615-95-C-2503 (5.1.1072) awarded by the Department of the Air Force.

BACKGROUND OF THE INVENTION

1. Technical Field

This invention relates to gas turbine engine stator vanes and rotor blades in general, and to stator vanes and rotor blades possessing internal cooling apparatus in particular.

2. Background Information

In the turbine section of a gas turbine engine, core gas travels through a plurality of stator vane and rotor blade stages. Each stator vane or rotor blade has an airfoil with one or more internal cavities surrounded by an external wall. The suction and pressure sides of the external wall extend between the leading and trailing edges of the airfoil. Stator vane airfoils extend spanwise between inner and outer platforms and the rotor blade airfoils extend spanwise between a platform and a blade tip.

High temperature core gas (which includes air and combustion products) encountering the leading edge of an airfoil will diverge around the suction and pressure sides of the airfoil, or impinge on the leading edge. The point along the leading edge where the velocity of the core gas flow goes to zero (i.e., the impingement point) is referred to as the stagnation point. There is a stagnation point at every spanwise position along the leading edge of the airfoil, and collectively those points are referred to as the stagnation line. Air impinging on the leading edge of the airfoil is subsequently diverted around either side of the airfoil.

Cooling air, typically bled off of a compressor stage at a temperature lower and pressure higher than the core gas passing through the turbine section, is used to cool the airfoils. The cooler compressor air provides the medium for heat transfer and the difference in pressure provides the energy required to pass the cooling air through the stator or rotor stage. Film cooling and internal convective/impingement cooling are prevalent airfoil cooling methods. Film cooling involves cooling air bled from an internal cavity which forms into a film traveling along an exterior surface of the stator or rotor airfoil. The film of cooling air increases the uniformity of the cooling and insulates the airfoil from the passing hot core gas. A person of skill in the art will recognize, however, that film cooling is difficult to establish and maintain in the turbulent environment of a gas turbine.

Convective cooling, on the other hand, typically includes passing cooling air through a serpentine of passages which include heat transfer surfaces such as "pins" and "fins" to increase heat transfer from the airfoil to the cooling air passing therethrough. Convective cooling also typically includes impingement cooling wherein cooling air jets through a metering hole, subsequently impinging on a wall surface to be cooled. An advantage of impingement cooling is that it provides localized cooling in the impinged upon region, and can be selectively applied to achieve a desirable result. A disadvantage of impingement cooling is that the convective cooling provided by the impingement is limited to a relatively small surface area. As a result, a large number of cooling apertures are required to cooling extended areas.

What is needed, therefore, is an airfoil with an internal cooling scheme that provides cooling more efficiently than is possible with presently available airfoils, one that promotes film cooling along the outside of the airfoil's exterior wall, and one that can be readily manufactured.

DISCLOSURE OF THE INVENTION

It is, therefore, an object of the present invention to provide an airfoil with an efficient internal cooling scheme.

It is another object of the present invention to provide an airfoil with an internal cooling scheme that promotes film cooling along the exterior surface of the airfoil.

It is another object of the present invention to provide an airfoil with improved cooling features that can be readily manufactured.

According to the present invention, a hollow airfoil is provided having a leading edge, a trailing edge, and a wall including a suction side portion and a pressure side portion. The wall, which includes an interior surface and an exterior surface, surrounds a first cavity and a second cavity, separated from one another by a rib extending between the suction side and pressure side wall portions. The first cavity is contiguous with the leading edge. The airfoil further includes a coolant flow splitter integrally formed with or otherwise attached to the wall interior surface within the first cavity, and at least one metering orifice disposed in the rib. The metering orifice(s) are substantially aligned with the coolant flow splitter, such that cooling air passing through the metering orifice(s) encounters the flow splitter. The flow splitter splits the cooling air flow and directs it along the wall interior surface.

An advantage of the present invention is that an airfoil with an efficient internal cooling scheme is provided. The internal cooling scheme of the present invention airfoil increases the convective heat transfer from the wall adjacent the leading edge by directing cooling air along the interior surface of the wall adjacent the leading edge. The directed flow of cooling air provides a greater rate of heat transfer than that associated with impingement cooling, where cooling air impinges then scatters randomly.

The internal cooling scheme also increases the efficiency of the convective cooling by dividing the cooling air flow according to need. For example, if the cooling requirements of the wall are greater on the suction side of the stagnation line, then the flow splitter is positioned to direct an appropriate amount of cooling air along the interior surface of the suction side portion of the wall. Hence, the volume of cooling air can be tailored to the need.

Another advantage of the present invention is that cooling air can be directed into a vortex or "swirl" on either side of the flow splitter to increase the rate of convective heat transfer. Prior art "swirl chambers" typically utilize a cavity tangentially fed with cooling air to create a vortex. The present invention avoids having to manufacture an airfoil with internal apertures tangentially entering a cavity and also permits that formation of two vortices rather than a single. The cooling air vortex on the suction and pressure sides can be tailored via the flow splitter and the geometry of the cavity to accommodate the cooling requirements in those regions.

Another advantage of the present invention is that the improved cooling features of the present invention airfoil can be readily manufactured in a lightweight form. The preferred embodiment of the present invention couples a trench along the leading edge substantially aligned with an internally disposed flow splitter. Coupling the trench and flow splitter allows for a substantially constant wall thickness which, in turn, minimizes weight.

These and other objects, features and advantages of the present invention will become apparent in light of the detailed description of the best mode embodiment thereof, as illustrated in the accompanying drawings.

BEST MODE FOR CARRYING OUT THE INVENTION

I. Apparatus

Figure 1:
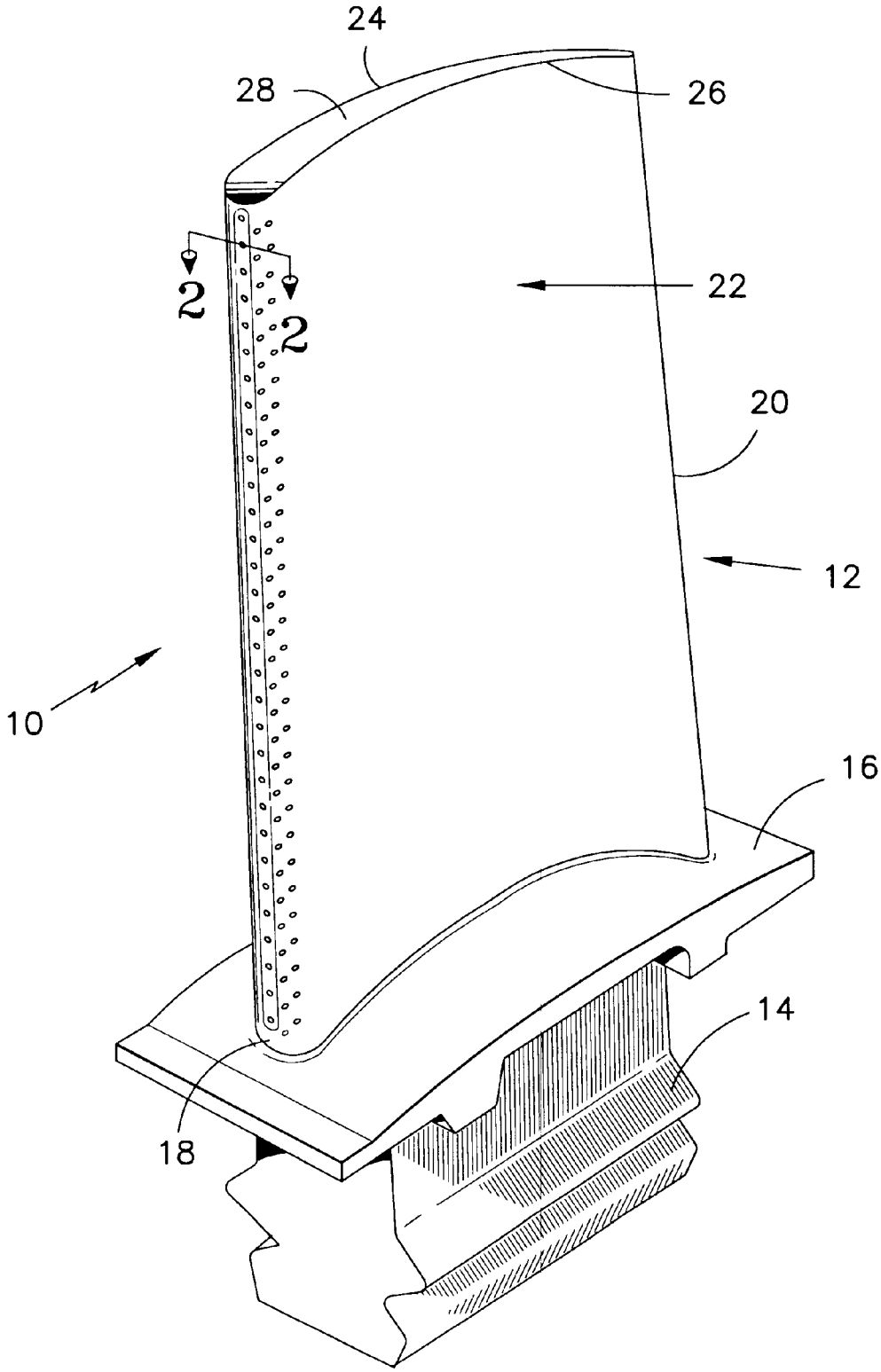
FIG. 1 is a diagrammatic view of a rotor blade.

Referring to FIG. 1, a rotor blade 10 for use in a gas turbine engine includes a hollow airfoil 12, a root 14, and a platform 16 disposed between the root 14 and the airfoil 12. The hollow airfoil 12 includes a forward ("leading") edge 18, an aft ("trailing") edge 20, and a wall 22 having a suction side portion 24 and a pressure side portion 26. The airfoil 12 extends spanwise between the platform 16 and the blade tip 28. The root 14 includes at least one internal cooling air duct (not shown) for the passage of cooling air up into the hollow airfoil 12.

Figure 2:
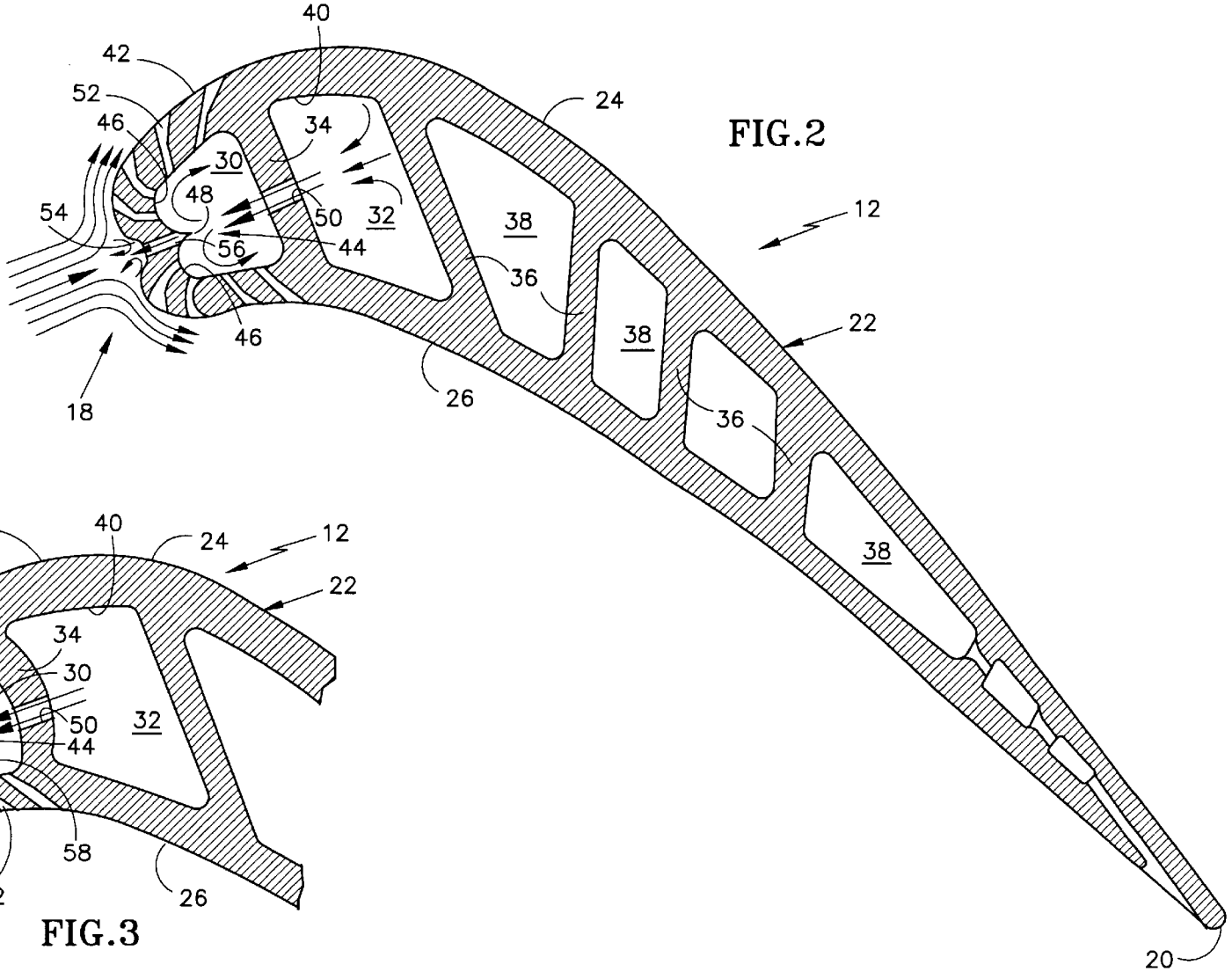
FIG. 2 is a diagrammatic cross-sectional view of an airfoil for use in a rotor blade or stator vane.
Figure 3:
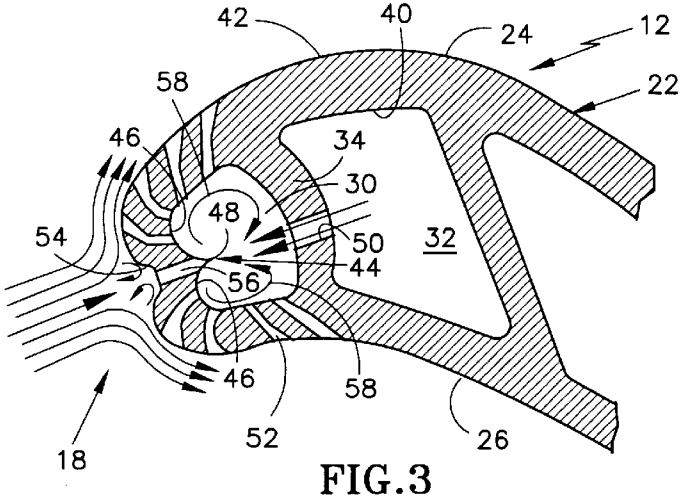
FIG. 3 is a diagrammatic partial cross-sectional view of an airfoil for use in a rotor blade or stator vane.

Referring to FIGS. 2 and 3, the airfoil wall 22 surrounds a first cavity 30 and a second cavity 32, separated from one another by a first rib 34. Additional ribs 36 separate additional cavities 38 aft of the second cavity 32. The first cavity 30 is contiguous with the leading edge 18. The wall 22 includes an interior surface 40 and an exterior surface 42. A coolant flow splitter 44, extending out from the wall interior surface 40 within the first cavity 30, includes a pair of surfaces 46 that intersect at a peak 48, and diverge into the wall interior surface 40. A plurality of metering orifices 50 are disposed in the first rib 34 between the first cavity 30 and the second cavity 32. Each metering orifice 50 is substantially aligned with the coolant splitter 44, such that cooling air flow passing through the metering orifice 50 encounters the flow splitter 44.

The leading edge 18 includes cooling orifices 52 oriented to create film cooling along the wall exterior surface 42 of the airfoil 12. The cooling orifices 52 may be arranged in a shower head arrangement as is well known in the prior art. In one embodiment, a trench 54 is disposed in the wall 22, extending spanwise along the leading edge 18. The trench 54 and the flow splitter 44 are substantially aligned with one another on the wall exterior surface 42 and the wall interior surface 40, respectively. Aligning the flow splitter 44 and the trench 54 minimizes wall thickness deviations in the vicinity of the flow splitter 44. In the embodiment shown, cooling orifices 56 extend through the wall 22, including the flow splitter 44, into the spanwise extending trench 54. Cooling air subsequently flows out of the trench 54 to create film cooling along the suction side portion 24 and the pressure side portion 26 of the airfoil 12. In a second embodiment (FIG. 3), the first rib 34 separating the first cavity 30 and the second cavity 32 has an arcuate shape to promote the formation of a cooling air vortex 58 on one or both sides of the flow splitter 44 within the first cavity 30.

II. Operation

While the airfoil 12 is in use, cooling air enters the airfoil 12, for example, via the blade root 14 and directly or indirectly passes into the second cavity 32 within the hollow airfoil 12. A portion of the cooling air within the second cavity 32 subsequently passes into the first cavity 30 through the metering orifices 50 disposed in the first rib 34 and encounters the flow splitter 44 extending out from the interior surface 40 of the wall 22. The positioning of each metering orifice 50 relative to the flow splitter 44 dictates what percentage of the cooling air passing through the metering orifice 50 will pass on a particular side of the flow splitter 44. Positioning a metering orifice 50 off center of the flow splitter 44 will cause more than 50% of the cooling air flow to travel along one side of the flow splitter 44, and less than 50% of the cooling air flow to travel along the opposite side of the flow splitter 44. The cooling air passing along the interior surface 40 of the wall 22 convectively cools the wall 22 and feeds the cooling orifices 52 disposed in that portion of the wall 22. Vortices 58 (FIG. 3) developed within the first cavity 30 encourage cooling air flow along the interior wall surface 40 and consequently the convective cooling of that portion of the wall 22.

In the embodiment having a trench 54, a portion of the cooling air enters cooling orifices 56 disposed in the wall 22 and subsequently passes into the trench 54 along the leading edge 18. Once in the trench 54, the cooling air diffuses into cooling air already in the trench 54 and distributes spanwise along the trench 54. One of the advantages of distributing cooling air within the trench 54 is that the pressure difference problems characteristic of conventional cooling orifices are minimized. For example, the difference in pressure across a cooling orifice is a function of the local internal cavity pressure and the local core gas pressure adjacent the orifice. Both of these pressures vary as a function of time. If the core gas pressure is high and the internal cavity pressure is low adjacent a particular cooling orifice in a conventional scheme, undesirable hot core gas in-flow can occur. The present invention minimizes the opportunity for the undesirable in-flow because the cooling air from orifices 56 collectively distributes within the trench 54, thereby decreasing the opportunity for any low pressure zones to occur. Likewise, the distribution of cooling air within the trench 54 also avoids cooling air pressure spikes which, in a conventional scheme, would jet the cooling air into the core gas rather than add it to the film of cooling air downstream.

Cooling air bled along the leading edge via a showerhead and/or a trench 54 subsequently forms a film of cooling air passing along the exterior surface 42 of the airfoil 12. Undesirable erosion of that film (due to turbulence and other factors) begins almost immediately, thereby negatively effecting the ability of the film to cool and insulate the airfoil 12. To offset the film erosion, it is known to position rows of diffusing type cooling orifices capable of providing cooling air to augment the film. A problem with the prior art is that cooling air within a cavity is not biased toward either wall portion (i.e., the suction side portion 24 or pressure side portion 26) and it is equally likely to be bled out of either wall portion 24,26, regardless of the cooling requirements of that wall portion 24,26. If the cooling requirements of one wall portion 24,26 are greater than that of the other, it is likely that maintaining an adequate cooling air flow through the "hotter" wall portion will result in an excess of cooling air flow through the "cooler" wall portion. To avoid using more cooling air than is necessary, the flow splitter 44 of the present invention provides appropriate cooling air flow along each wall portion thereby increasing the cooling efficiency of the airfoil 12.

Although this invention has been shown and described with respect to the detailed embodiments thereof, it will be understood by those skilled in the art that various changes in form and detail thereof may be made without departing from the spirit and the scope of the invention. For example, the best mode of the present invention has been described in terms of a rotor blade airfoil. The present invention is, however, equally applicable to stator vane airfoils as can be seen in FIGS. 2 and 3.

I claim:

1. A hollow airfoil having a leading edge and a trailing edge, said airfoil comprising:

a wall having a suction side portion, a pressure side portion, an interior surface, and an exterior surface, said wall surrounding a first cavity and a second cavity, said cavities separated from one another by a rib extending between said suction side wall portion and said pressure side wall portion, wherein said first cavity is contiguous with the leading edge;

a coolant flow splitter attached to said interior surface within said first cavity, said flow splitter substantially aligned with and extending along with the leading edge;

at least one metering orifice disposed in said rib and substantially aligned with said coolant flow splitter, such that cooling air passing through said metering orifice encounters said flow splitter;

a trench disposed in said wall, substantially aligned with the leading edge and extending spanwise along the leading edge; and a plurality of cooling orifices disposed within said wall extending between said trench and said first cavity through said flow splitter, thereby providing a cooling air passage between said internal cavity and said trench.

2. A hollow airfoil according to claim 1, wherein said rib is arcuately shaped.

3. A hollow airfoil, comprising:

a wall having a suction side portion and a pressure side portion extending between a leading edge and a trailing edge;

a first cavity contiguous with said leading edge;

a second cavity;

a rib extending between said suction side wall portion and said pressure side wall portion, separating said cavities;

a coolant flow splitter extending along said leading edge within said first cavity;

at least one metering orifice disposed in said rib and substantially aligned with said coolant flow splitter, such that cooling air passing through said metering orifice encounters said flow splitter; and a plurality of cooling orifices disposed within said wall extending through said flow splitter.

4. The hollow airfoil of claim 3, further comprising:

a trench disposed in said wall, substantially aligned with and extending along said leading edge.

5. A hollow airfoil, comprising:

a wall having a suction side portion and a pressure side portion extending between a leading edge and a trailing edge, and an interior surface and an exterior surface;

a first cavity contiguous with said leading edge;

a second cavity;

a rib extending between said suction side wall portion and said pressure side wall portion, separating said cavities;

a coolant flow splitter extending along said leading edge within said first cavity;

at least one metering orifice disposed in said rib and substantially aligned with said coolant flow splitter, such that cooling air passing through said metering orifice encounters said flow splitter; and a trench disposed in said exterior surface of said wall, substantially aligned with said flow splitter.

6. The hollow airfoil of claim 5, further comprising:

a plurality of cooling orifices extending through said wall between said trench and said first cavity.

* * * * *